United States Patent [19]

Barbour

[11] 4,116,106

[45] Sep. 26, 1978

[54] METHOD AND PLUG FOR CONCEALING FASTENER ANCHOR

[75] Inventor: William P. Barbour, Westminister, Md.

[73] Assignee: Kile, Gholz, Bernstein & Georges, Arlington, Va. ; part interest to each

[21] Appl. No.: 806,448

[22] Filed: Jun. 14, 1977

[51] Int. Cl.[2] ..... E04G 23/02; F16B 13/06

[52] U.S. Cl. ..... 85/71; 52/514; 85/5 R; 85/28; 85/50 R

[58] Field of Search ..... 52/514; 85/70, 71, 50, 85/51, 52, 45, 5 R, 28; 29/401 R, 401 E; 144/310 R, 310 B; 427/140, 290

[56] References Cited

U.S. PATENT DOCUMENTS

| | | | |
|---|---|---|---|
| 293,726 | 2/1884 | Fancher | 52/514 |
| 1,881,973 | 10/1932 | Schmitt | 85/71 |
| 2,353,110 | 7/1944 | Camp | 85/28 |
| 2,552,066 | 5/1951 | Sorensen | 85/5 R X |
| 2,559,281 | 7/1951 | Croessant | 85/71 |
| 2,585,285 | 2/1952 | Tonge et al. | 85/5 R X |
| 2,927,497 | 3/1960 | Rapata | 85/5 R |
| 3,230,817 | 1/1966 | Thomas | 85/28 |
| 3,888,156 | 6/1975 | Fima | 85/71 |
| 3,889,436 | 6/1975 | Elliott | 52/514 |
| 3,918,207 | 11/1975 | Aliotta | 52/514 X |
| 4,016,696 | 4/1977 | Mess et al. | 52/514 |
| 4,062,165 | 12/1977 | Marks et al. | 52/514 |

FOREIGN PATENT DOCUMENTS

| | | | |
|---|---|---|---|
| 465,234 | 8/1951 | Italy | 85/70 |
| 873,960 | 8/1961 | United Kingdom | 85/28 |
| 1,380,500 | 1/1975 | United Kingdom | 85/45 |
| 429,192 | 4/1975 | U.S.S.R. | 85/50 R |

*Primary Examiner*—Rodney H. Bonck
*Attorney, Agent, or Firm*—Charles L. Gholz

[57] ABSTRACT

Disclosed is an anchor bolt and anchor fastener combination, a plug for filling the hole left by removal of the anchor bolt from the anchor fastener and for facilitating the refinishing of the surface, and a method employing the combination and the plug to conceal the anchor fastener after its useful purpose has been served. The combination includes a stepped washer which is used in the method to embed the head of the anchor fastener in an object such that the outer surface of the head of the anchor fastener is beneath the surface of the object, leaving a depression in the object. The plug comprises a shaft portion the diameter of which is sized to fit snugly into the hole in the head of the anchor fastener and a head portion sized and shaped to fit snugly into and substantially fill the depression.

16 Claims, 7 Drawing Figures

METHOD AND PLUG FOR CONCEALING FASTENER ANCHOR

BACKGROUND OF THE INVENTION

The subject invention relates to fasteners of the type comprising an anchor fastener and an anchor bolt. In use, the anchor fastener is embedded in an object, such as a plaster wall, and the anchor bolt, which is threadedly received within the anchor fastener, is used first to expand the inner end of the anchor fastener within the object to prevent its later removal and then to mount a second object to the first object. Such fasteners are also referred to as "expansion bolts".

While many millions of such fasteners are used annually, they are not without their drawbacks. One particularly apparent drawback, to the solution of which the subject invention is directed, is that the anchor fastener remains embedded in the object after the fastener is no longer needed. Since the outer surfaces of the anchor fasteners are unsightly when no longer in use, they are normally either removed or concealed when no longer needed. This operation can become a significant expense, particularly when an apartment has been vacated and is being renovated for a new occupant.

The method used at present to conceal anchor fasteners in walls after they have served their useful purpose is as follows:

(1) the head of the fastener is driven below the surface of the wall by hammer blows, great care being taken not to drive the fastener clear through the wall;

(2) a first application of spackling plaster is pressed into the rather large recess thus produced and allowed to remain slightly higher than the surrounding surface;

(3) after the first application of spackling plaster has fried, leaving a depression in the center due to shrinkage of the plaster during drying, a second application of spackling plaster is pressed into the depression; and (4) after the second application of spackling plaster has dried, the area is sanded smooth and to the level of the surrounding wall.

Obviously, the operation described above is inconvenient for the home owner and expensive for the apartment owner because of the need to allow time (usually a full day) for the drying of at least the first application of spackling plaster and because of the extensive sanding involved.

OBJECT OF THE INVENTION

It it, therefore, a general object of the invention to provide a fastener which will obviate or minimize problems of the type previously described.

It is a particular object of the invention to provide a fastener of the type comprising an anchor fastener and an anchor bolt in which the anchor bolt can be removed and the resulting hole concealed rapidly and inexpensively.

Other objects and advantages of the present invention will become apparent from the following detailed description of two preferred embodiments thereof taken in conjunction with the accompanying drawings.

DETAILED DESCRIPTION OF THE PRESENTLY PREFERRED EMBODIMENTS

Figure 1:
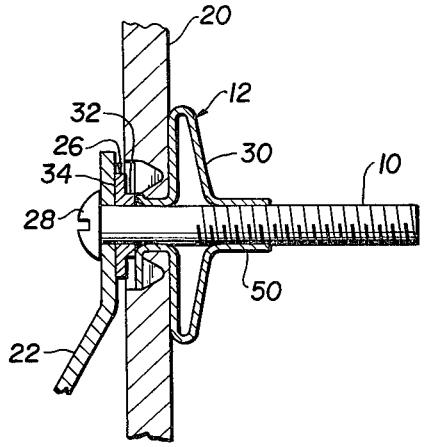
FIG. 1 is a sectional view of a preferred embodiment of a fastener according to the present invention in use.
Figure 2:
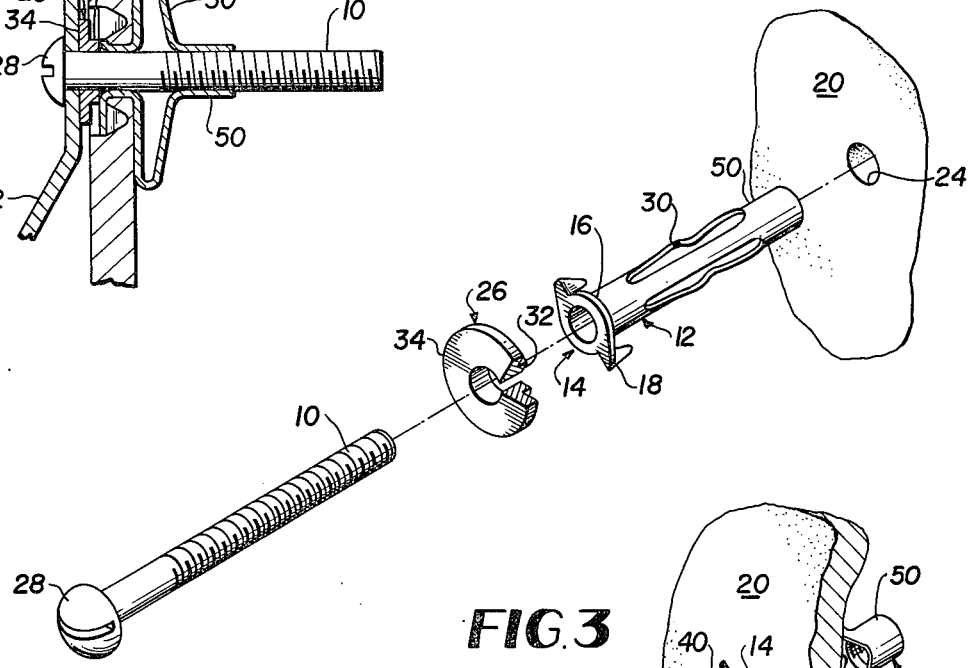
FIG. 2 is an exploded perspective view of the embodiment shown in FIG. 1 prior to use.

FIGS. 1 and 2 show a conventional anchor bolt 10 and an anchor fastener 12 which is conventional apart from its head 14. As best seen in FIG. 2, the head 14 comprises an annular collar 16 and at least one (preferably two) ear 18 extending outwardly from the annular collar 16 and carrying a prong which is adapted to prevent rotation of the annular fastener during use. The annular collar 16 is much smaller than the head of conventional expansion bolts, and in fact it can be dispensed with altogether insofar as the present invention is concerned. It is illustrated, however, because it is believed that it will be easier to fabricate expansion bolts according to the present invention, which preferably include two ears 18, if the ears 18 and the annular collar 16 are made separately from one piece and then welded to the remainder of the anchor fastener 12. In any event, the axially inner area of the head of the anchor fastener 12 is reduced to the minimum necessary to carry the prong or prongs used. In FIG. 1, the anchor fastener 12 is shown embedded in a wall 20, and the anchor bolt 10 is shown threaded into the anchor fastener 12 and holding an object 22 in position on the wall 16. In FIG. 2, the anchor fastener 12 is shown prior to insertion into a hole 24 in the wall 20 and expansion into the shape shown in FIG. 1. As will be fully appreciated hereinafter, the exact shape of the anchor bolt 10 and the anchor fastener 12 apart from its head 14 are of no importance to the present invention and any suitable form can be used.

To the conventional combination previously described, the present invention adds a stepped washer 26 located between the head 28 of the anchor bolt 10 and the head 14 of the anchor fastener 12 when the anchor fastener 12 is being embedded in an object such as the wall 20 and when the shaft 30 of the anchor fastener 12 is being expanded by the turning of the anchor bolt 10 within the anchor fastener 12. As best seen in FIG. 1, the stepped washer 26 comprises a shaft portion 32 sized such that its axial inner face bears against the annular collar 16 of the anchor fastener 12 but does not extend radially outwardly beyond the annular collar 16 and a head portion 34 carried by (and preferably integral with) the shaft portion 32 and sized such that its axial inner face extends radially outwardly beyond the annular collar 16 of the anchor fastener 12 and, during use, bears against the surface of the object, such as the wall 20, in which the anchor fastener 12 is embedded.

As will be appreciated, the above design insures that, during use, the head 14 of the anchor fasteners 12 is embedded in the object by a distance equal to the length of the shaft portion 32. The fact that the total axially inner surface area of the annular collar 16 and the ears 18 is much less than the axially inner surface area of the head of a conventional anchor fastener facilitates the embedding of the head 14 in the object, and the axially inner surface of the head portion 34 of the stepped washer 26 which projects outwardly beyond the annular collar 16 serves as a shoulder which stops further inward motion of the head 14 of the anchor fastener 12 unless a significantly larger force is applied to the head 28 of the anchor bolt 10.

As shown, the shaft portion 32 and the head portion 34 of the stepped washer 26 are both preferably round in cross-section and concentric to one another, but it is not absolutely essential that they be so. Similarly, the axially inner face of the shaft portion 32 is preferably substantially complimentary in size to the annular collar 16 of the anchor fastener 12 (or to the axially outer end of the shaft 30 if the annular collar 16 is omitted), but it may be somewhat smaller in size.

FIGS. 3 through 6 show a plug 36 adapted to fill the hole 38 left by removal of the anchor bolt 10 from the anchor fastener 12 shown embedded in the wall 20 such that the outer surface of the head 14 of the anchor fastener 12 is beneath the surface of the object, leaving a depression 40 in that surface. As will be appreciated, the depression 40 is preferably, but not necessarily, created by the action of the stepped washer 26 described previously. In any event, the plug 36 comprises a shaft portion 42 and a head portion 44 carried by (and preferably integral with) the shaft portion 42 and sized and shaped to fit snugly into and substantially fill the depression 40. The shaft portion 42 in turn preferably comprises a cylindrical portion 46 the diameter of which is sized to fit snugly into the hole 38 and a serrated blade portion 48. The dimensions of the shaft portion 42 are preferably such that, in use, the serrated blade portion 48 extends into the threaded portion 50 of the anchor fastener 12. To aid in the retention of the plug 36 in the anchor fastener 12, at least the blade portion 48 of the shaft portion 42 is preferably made from a resilient plastic, allowing its serrations to cooperate with the threads in the threaded portion 50 of the anchor fastener 12 to hold the plug 36 in place. If the plug 36 has a round head, the serrations on the blade portion 48 may even be threads designed to mate with the threads in the anchor fastener 12. If, however, the head portion 44 is shaped as shown in the drawings (i.e., it includes at least one ear portion 52 extending radially outwardly from the axis of the shaft portion 42 to fill a depression 40 shaped as shown in the drawings), then the insertion of the plug 36 is purely axial, not rotational, and the serrations are preferably "fish hook" shaped, as shown, to facilitate insertion and deter removal. Of course, the blade portion 48 may be cylindrical and the cylindrical portion 46 may be blade shaped, but the illustrated configuration is believed to be the optimal shape.

Figure 7:
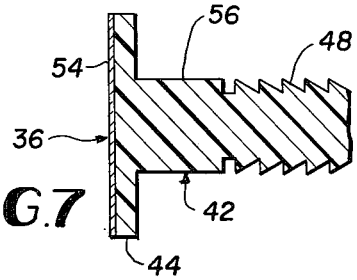
FIG. 7 is a view similar to FIG. 5 of a second embodiment of a plug according to the present invention.

The embodiment shown in FIG. 7 is generally similar to the embodiment shown in FIGS. 3–6, and the same reference numbers have been used where applicable. However, the embodiment shown in FIG. 7 additionally comprises a thin layer 54 of spackling plaster carried by the outer surface of the head portion 44. Instead of the thin uniform layer shown, the spackling plaster can also be applied in a ridge about the outer periphery of the outer face of the head portion 44, or in any other configuration on that face.

A method of concealing an anchor fastener embedded in an object after its useful purpose has been served will now be described. As will be appreciated, the method preferably, but not necessarily, employs both the stepped washer 26 and the plug 36 previously described.

In any event, the first step of the method is embedding the head 14 of the anchor fastener 12 in the object 20 such that its outer surface is beneath the surface of the object leaving the depression 40 in the object. This step is preferably, but not necessarily, carried out at the time the anchor fastener 12 is originally installed, and, of course, it is preferably carried out with the aid of the stepped washer 26, which is designed to insure that the depression 40 is of a particular, pre-selected depth. Assuming that the first step is carried out at the time that the achor fastener 12 is originally installed and that the stepped washer 26 is employed, the washer 26 may then be retained as part of the combination, as shown in FIG. 1, or it may be discarded or reused with another anchor fastener.

The second step of the method is removing the anchor bolt 10 from the anchor fastener 12. This step is, of course, carried out when the anchor fastener has served its useful purpose, and this step may precede, but normally follows, the first step.

Figure 3:
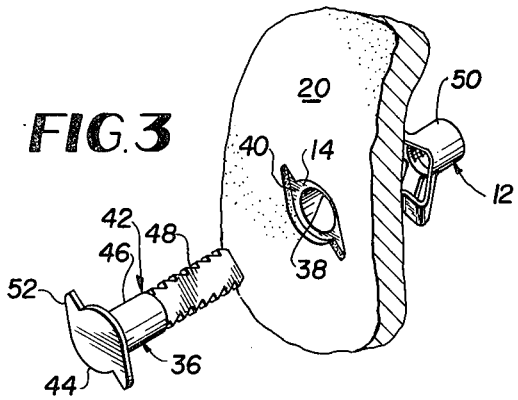
FIG. 3 is an exploded perspective view of a first embodiment of a plug according to the present invention prior to use.
Figure 4:
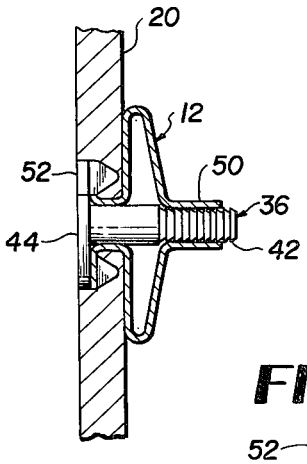
FIG. 4 is a sectional view of the embodiment shown in FIG. 3 in use.
Figure 5:
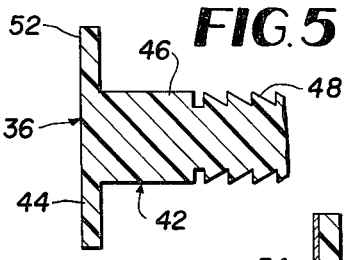
FIG. 5 is a view along the lines 5—5 in FIG. 3.
Figure 6:
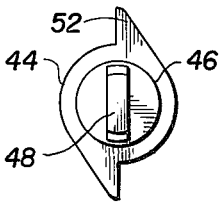
FIG. 6 is a view along the line 6—6 in FIG. 3.

Finally, the third essential step of the method is inserting the plug 36 into the hole 38 left by the removal of the anchor bolt 10 so as to substantially fill the depression 40. As previously indicated, the motion of insertion is substantially linear where the plug 36 is shaped as shown in FIG. 3, but may be rotational as well as linear if the head portion 44 of the plug 36 is round.

Additionally, the method may comprise the steps of applying a thin coating of spackling plaster to the interface between the head portion 44 of the plug 36 and the surface of the object 20 after the plug 36 has been inserted into the hole 38, or the layer 54 of spackling plaster may be moistened and worked into that interface. Either way, such a small amount of spackling plaster is needed that it dries almost instantly and requires no sanding, thus permitting the entire operation of concealing the anchor fastener and refinishing the surface of the object to be accomplished in a single session.

Caveat

While the present invention has been illustrated by detailed descriptions of preferred embodiments thereof, it will be obvious to those skilled in the art that various changes in form and detail can be made therein without deparing from the true scope of the invention. For that reason, the invention must be measured by the claims appended hereto and not by the foregoing preferred embodiments.

What is claimed is:

1. In combination, (a) an anchor fastener comprising a hollow shaft and a head having a hole therein, said anchor fastener being shaped to receive an anchor bolt fitting through the hole in the head of said anchor fastener and into the hollow shaft, and (b) a plug for filling the hole left by removal of an anchor bolt from said anchor fastener when said anchor fastener is embedded in an object such that the outer surface of the head of the anchor fastener is beneath the surface of the object forming a depression, and for facilitating the refinishing of the surface of the object, said plug comprising:

(i) a shaft portion the diameter of which is sized to fit into the hole in the head of said anchor fastener and (ii) a head portion carried by said shaft portion and sized and shaped to fit snugly into and substantially fill the depression in the surface of the object.

2. The combination of claim 1 wherein:

(a) a portion of the hollow shaft of said anchor fastener remote for the head is internally threaded and (b) the shaft portion of said plug comprises:

(i) a first portion the diameter of which is sized to fit snugly into the hole in the head of said anchor fastener and (ii) a second portion which is sized to extend into the threaded portion of the anchor fastener.

3. The combination of claim 2 wherein said second portion:

(a) is made from a resilient plastic and (b) has serrations thereon which cooperate with the threads in the threaded portion of said anchor fastener.

4. The combination of claim 3 wherein the serrations are "fish hook" shaped to facilitate insertion and to deter removal of said second portion from the threaded portion of said anchor fastener.

5. The combination of claim 2 wherein said first portion is cylinderical in shape and said second portion is in the shape of a blade.

6. The combination of claim 1 wherein said plug is made from a resilient plastic.

7. The combination of claim 1 and further comprising spackling plaster carried by the outer surface of said head portion.

8. The combination of claim 1 wherein:

(a) a portion of the hollow shaft of said anchor fastener remote from the head is internally threaded and (b) the length of said shaft portion is such that, in use, it extends into the threaded portion of sand anchor fastener.

9. The combination of claim 1 wherein said head portion includes at least one ear portion extending radially outwardly from the axis of said shaft portion.

10. In combination, (a) an anchor fastener comprising a hollow shaft and a head having a hole therein, said anchor fastener being shaped to receive an anchor bolt fitting through the hole in the head of said anchor fastener and into the hollow shaft;

(b) an anchor bolt comprising:

(i) a shaft portion the diameter of which is sized to fit into the hole in the head of said anchor fastener and (ii) a head portion carried by said shaft portion and (c) a stepped washer located between the head portion of said anchor bolt and the head of said anchor fastener when said anchor fastener is being embedded in an object, said stepped washer comprising:

(i) a shaft portion sized such that the axially inner face of said shaft portion bears against the head of said anchor fastener but does not extend radially outwardly beyond the head of said anchor fastener and (ii) a head portion carried by said shaft portion and sized such that the axially inner face of said head portion extends radially outwardly beyond the head of said anchor fastener and, during use, bears against the surface of the object in which said anchor fastener is being embedded, whereby, during use, the head of said anchor fastener is embedded in the object by a distance equal to the length of the shaft portion of said stepped washer.

11. A combination as recited in claim 10 wherein the shaft and head portions of said stepped washer are both round in cross-section and are concentric to one another.

12. A combination as recited in claim 10 wherein the head of said anchor fastener comprises at least one prong shaped and positioned to prevent rotation of said anchor fastener during use and wherein the axially inner area of the head of said anchor fastener is reduced to the minimum necessary to carry the prong.

13. A combination as recited in claim 12 wherein the head of said anchor fastener comprises an annular collar and at least one ear extending radially outwardly from the annular collar and carrying the prong.

14. A method of concealing an anchor fastener embedded in an object after its useful purpose has been served, said anchor fastener comprising a hollow shaft and a head having a hole therein and said anchor fastener being shaped to receive an anchor bolt fitting through the hole in the head of said anchor fastener and into the hollow shaft, said method comprising the steps of:

(1) embedding the head of said anchor fastener in the object such that the axially outer surface of the head of said anchor fastener is beneath the surface of the object by a predetermined amount, leaving a depression in the object;

(2) removing said anchor bolt from said anchor fastener; and (3) inserting into the said anchor fastener a plug comprising:

(i) a shaft portion the diameter of which is sized to fit into the hole and (ii) a head portion carried by said shaft portion and sized and shaped to fit snugly into and fill the depression in the surface of the object.

15. The method of claim 14 and further comprising the step of applying a thin coat of spackling plaster to the interface between the head of said plug and the surface of the object after said plug has been inserted into said anchor fastener.

16. The method of claim 14 wherein:

(a) said anchor bolt comprises:

(i) a shaft portion the diameter of which is sized to fit into the hole in the head of said anchor fastener and (ii) a head portion carried by said shaft portion and (b) the depth to which the head of said anchor fastener is embedded in the object is predetermined by means of a stepped washer which is located between the head portion of said anchor bolt and the head of said anchor fastener when said anchor fastener is being embedded in the object, said stepped washer comprising:

(i) a shaft portion sized such that the axially inner face of said shaft portion bears against the head of said anchor fastener but does not extend radially outwardly beyond the head of said anchor fastener and (ii) a head portion carried by said shaft portion and sized such that the axially inner face of said head portion extends radially outwardly beyond the head of said anchor fastener and, during use, bears against the surface of the object in which said anchor fastener is being embedded, whereby the head of said anchor fastener is embedded in the object by a distance equal to the length of the shaft portion of said stepped washer.

* * * * *